US006543614B2

(12) United States Patent
Nii

(10) Patent No.: US 6,543,614 B2
(45) Date of Patent: Apr. 8, 2003

(54) LENS HOUSING CONTAINER

(75) Inventor: Tamotsu Nii, Hachioji (JP)

(73) Assignee: Konica Corporation, Tokyo (JP)

( * ) Notice: Subject to any disclaimer, the term of this patent is extended or adjusted under 35 U.S.C. 154(b) by 59 days.

(21) Appl. No.: 09/899,170

(22) Filed: Jul. 6, 2001

(65) Prior Publication Data

US 2002/0003097 A1 Jan. 10, 2002

(30) Foreign Application Priority Data

Jul. 7, 2000 (JP) ..... 2000-206406

(51) Int. Cl.[7] ..... B65D 85/38
(52) U.S. Cl. ..... 206/316.1; 206/454
(58) Field of Search ..... 206/5.1, 316.1, 206/445, 454, 509, 714, 820

(56) References Cited

U.S. PATENT DOCUMENTS

| | | | | | |
|---|---|---|---|---|---|
| 860,264 | A | * | 7/1907 | Stevens | 206/316.1 |
| 3,719,273 | A | | 3/1973 | Abe | |
| 3,889,815 | A | * | 6/1975 | Merle | 206/454 |
| 4,494,667 | A | * | 1/1985 | Griffith | 206/509 |
| 4,654,693 | A | | 3/1987 | Funakoshi et al. | |
| 4,796,756 | A | * | 1/1989 | Ott | 206/454 |
| 5,333,732 | A | * | 8/1994 | Bunday | 206/316.1 |
| 5,440,458 | A | * | 8/1995 | Volk | 206/5.1 |
| 5,454,469 | A | * | 10/1995 | Budny et al. | 206/316.1 |
| 5,960,951 | A | * | 10/1999 | Nomura et al. | 206/316.1 |
| 6,050,406 | A | * | 4/2000 | Nomura et al. | 206/316.1 |
| RE37,558 | E | * | 2/2002 | Abrams et al. | 206/5.1 |

FOREIGN PATENT DOCUMENTS

| | | |
|---|---|---|
| FR | 2 430 371 | 2/1980 |

* cited by examiner

*Primary Examiner*—Jim Foster
(74) *Attorney, Agent, or Firm*—Finnegan, Henderson, Farabow, Garrett & Dunner, L.L.P.

(57) ABSTRACT

A lens housing container for housing a plurality of lenses, comprising a long carrier tape having a supporting portion for supporting one ring-shaped surface of the flange portion of the lens, and a plurality of lens housing portions; and a long cover tape to be stuck on the carrier tape so as to cover the lens housed in the lens housing portion, wherein the supporting portion supports the one ring-shaped surface of the flange portion of the lens, so as not to come into contact with the one lens surface of the lens, the lens housing portion houses the lens so that a part of the other lens surface of the lens is projected from or is flush with the upper surface of the carrier tape, the cover tape restrains the lens housed in the lens housing portion from moving in the optical axis direction.

10 Claims, 8 Drawing Sheets

LENS HOUSING CONTAINER

BACKGROUND OF THE INVENTION

This invention relates to a lens housing container for housing a lens having a flange portion formed along the edge of the main body of the lens.

In recent years, accompanied by the optical disk device becoming of high precision and compact, the thickness and the outer size of a lens for use in an optical pickup has become remarkably small.

Accordingly, it has been proposed to set a lens in a form housed in such a lens housing container as shown in FIG. 6 and FIG. 7 to a lens fitting device.

In these drawings, a plurality of cylindrical-shaped lens housing portions 1013 are formed in the long carrier tape 1010 by using a thermal forming method for example.

On the other hand, the lens 1001 is composed of the lens main body 1003 and the flange portion 1005 formed along the edge of the lens main body 1003, and the lens surfaces 1007 and 1007' project out of the ring-shaped surfaces 1009 and 1009' of the flange portion 1005.

In the lens housing portion 1013 of the carrier tape 1010, the lens 1001 is housed in such a manner that it comes to the opening side the lens surface 1007 which projects out of the ring-shaped surface 1009 of the flange portion 1005 of the lens 1001, and the supporting portion 1015 for supporting the ring-shaped surface 1009' of the flange portion 1005 of the lens 1001 at the reverse side to the opening is formed in order not to make the other lens surface 1007' come into contact with the carrier tape.

Further, the housing portion is designed in such a manner that the depth from the supporting portion 1015 of the lens housing portion 1013 of the carrier tape 1010 up to the opening is approximately equal to the thickness of the flange portion 1005 of the lens 1001.

Accordingly, when the lens 1001 is housed in the lens housing portion 1013, the lens surface 1007 become projected out of the carrier tape 1010.

Further, by putting the cover tape 1021 so as to cover the opening of the lens housing portion 1013, the flange portion 1007 of the lens 1001 is made to press the supporting portion 1015; thus, in the lens housing portion 1013, it is prohibited that the lens 1001 moves in the optical axis direction, and it is prevented that the lens surface 1007 is flawed by the cover tape 1021.

The carrier tape 1010 having the cove tape 1021 stuck on it is wound onto the reel 1008, and is set in the lens fitting device.

However, in the lens housing container shown in FIG. 6 and FIG. 7, when the carrier tape having the cover tape 1021 stuck on it is wound round, as shown in FIG. 8, the bottom surface of the lens housing portion 1013 of the carrier tape 1010, which is wound around the outer side of the cover tape 1021 with which the lens surface 1007 is in contact, comes into sliding contact with the cover tape 1021, and by the movement of the cover tape 1021 in the direction of winding, it sometimes occurs that the lens surface 1007 of the lens 1001 is flawed.

SUMMARY OF THE INVENTION

This invention has been made in view of the above-mentioned problem, and it is an object of the invention to provide a lens housing container which does not make the lens surface flawed when the carrier tape is wound round.

This invention to solve the above-mentioned problem is represented by any one of structures (1) to (8) described below.

Structure (1): A lens housing container for housing a plurality of lenses, comprising a long carrier tape having a supporting portion for supporting one ring-shaped surface of the flange portion of said lens, and a plurality of lens housing portions; and a long cover tape to be stuck on said carrier tape so as to cover said lens housed in said lens housing portion, wherein said supporting portion supports said one ring-shaped surface of said flange portion of said lens, so as not to come into contact with said one lens surface of said lens, said lens housing portion houses said lens so that a part of the other lens surface of said lens is projected from or is flush with the upper surface of said carrier tape, said cover tape restrains said lens housed in said lens housing portion from moving in the optical axis direction, said carrier tape has projections, and in order to make a clearance, in the state that said carrier tape having said cover tape stuck on it is wound round, between the portion of the cover tape facing said other lens surface of said lens housed in said lens housing portion and the portion of said carrier tape which is wound outside it, said projections of said carrier tape which is wound outside come into contact with the portion of the carrier tape or the cover tape which is wound inside.

Structure (2): The lens housing container as set forth in structure (1), wherein the aforesaid cover tape is in contact with the other surface of the lens housed in the lens housing portion.

Structure (3): The lens housing container as set forth in structure (1), wherein the projections are formed in the outer side area of a tangent which is tangent to the circular edge of the other lens surface of the lens to be housed and is parallel to the direction of winding of the carrier tape.

Structure (4): The lens housing container as set forth in structure (1), wherein the height of the projections is equal to or larger than the sum of the projection amount of the housing portion from the carrier tape and the projection amount of the other lens surface of the lens from the other ring-shaped surface of the flange portion.

Structure (5): The lens housing container as set forth in structure (1), wherein the projections are provided on the back surface of the lens housing portions.

Structure (6): The lens housing container as set forth in structure (1), wherein any two projections which are adjacent to each other in the winding direction among the projections have different cross-sectional shapes in the direction perpendicular to the height direction of the projections respectively.

Structure (7): The lens housing container as set forth in structure (1), wherein any two projections which are adjacent to each other in the winding direction among the projections are located at different positions with respect to said lens housing portions.

Structure (8): The lens housing container as set forth in structure (1), wherein the lens is a plastic lens.

Another preferable structures (9) to (14) of the present invention are as follows.

Structure (9) is a lens housing container comprising a long carrier tape having a plurality of lens housing portions having a supporting portion for supporting one ring-shaped surface of the flange portion of a lens formed so as not to make one surface of the lens come into contact with the bottom of the housing portion, in such a manner as to make a part of the other lens surface of said lens housed project out of or become flush with the upper surface of said carrier tape, and a long cover tape to be stuck on said carrier tape so as to cover the lens housed in the housing portion, and restraining said lens from moving in the optical axis direction by said cover tape, wherein, in order to make a clearance, in the state that said carrier tape having said cover tape stuck on it is wound round, between the portion of the cover tape facing the other lens surface of the lens housed in said lens housing portion and the portion of the carrier tape which is wound outside it, projections coming into contact with the portion of the carrier tape or the cover tape which is wound inside are formed on said carrier tape.

In order to make a clearance, in the state that said carrier tape having said cover tape stuck on it is wound round, between the portion of the cover tape facing the other lens surface of the lens housed in said lens housing portion and the portion of the carrier tape which is wound outside it, by forming projections coming into contact with the portion of the carrier tape or the cover tape which is wound inside on said carrier tape, the lens surface is not flawed when said carrier tape having said cover tape stuck on it is wound round.

In addition, in this invention, the flange portion means not only the portion which is definitely different in shape from the lens main body as shown in FIG. 2, but also the portion which is capable of being used optically but not to be used optically when it is actually mounted in a device or the like.

Structure (10) is a lens housing container as set forth in structure (9) wherein the aforesaid projections are formed in the outer side area of a tangent which is tangent to the circular edge of the other lens surface of the lens to be housed and is parallel to the direction of winding of said carrier tape.

By forming the projections at the outer side of a tangent which is tangent to the circular edge of the other lens surface of the lens to be housed and is parallel to the direction of winding of said carrier tape, it never occurs that the projections come into contact with the portion of the cover tape facing the other lens surface when the tape is wound round, and the lens surface is never flawed.

Structure (11) is a lens housing container as set forth in structure (9) wherein the height of the aforesaid projections is equal to or larger than the sum of the projection amount of the aforesaid housing portion from the carrier tape and the projection amount of the other surface of said lens from the other ring-shaped surface of the aforesaid flange portion.

By making the height of the aforesaid projections equal to or larger than the sum of the projected amount of aforesaid housing portion from the carrier tape and the projected amount of the other surface of said lens from the other ring-shaped surface of the aforesaid flange portion, the portion of the cover tape facing the lens surface does not come into contact with the bottom surface of the lens housing portion of the carrier tape wound outside it; therefore, the lens surface is not flawed.

Structure (12) is a lens housing container as set forth in structure (9) wherein the aforesaid projections are provided on the bottom surface of the aforesaid lens housing portions.

By providing said projections on the bottom surface of said lens housing portions, the clearance between the portion of the cover tape facing the other lens surface of the lens housed in said lens housing portion and the carrier tape which is wound outside it can be set at a small value.

Structure (13) is a lens housing container as set forth in structure (9) wherein the aforesaid projections are of at least any one of two kinds of projections, one of which is such one that any two projections which are adjacent to each other in the winding direction have different cross-sectional shapes in the direction perpendicular to the height of said projections respectively, and the other of which is such one that any two projections which are adjacent to each other in the winding direction are located at different positions with respect to said lens housing portions.

By making the projections be of at least any one of two kinds of projections, one of which is such one that any two projections which are adjacent to each other in the winding direction have different cross-sectional shapes in the direction perpendicular to the height of said projections respectively, and the other of which is such one that any two projections which are adjacent to each other in the winding direction are located at different positions with respect to said lens housing portions, the probability of one projection fitting into another projection is reduced when the carrier tape is wound round.

As a lens that is suitable to be housed in a lens housing container as set forth in any one of Structures (9) to (13), a plastic lens of structure (14) which is easy to flaw if it is handled without care can be cited.

In addition, this invention should not be confined to a plastic lens, but it is needless to say that a lens housing container of this invention can be applied to a glass lens.

DETAILED DESCRIPTION OF THE PREFERRED EMBODIMENT

Figure 1:
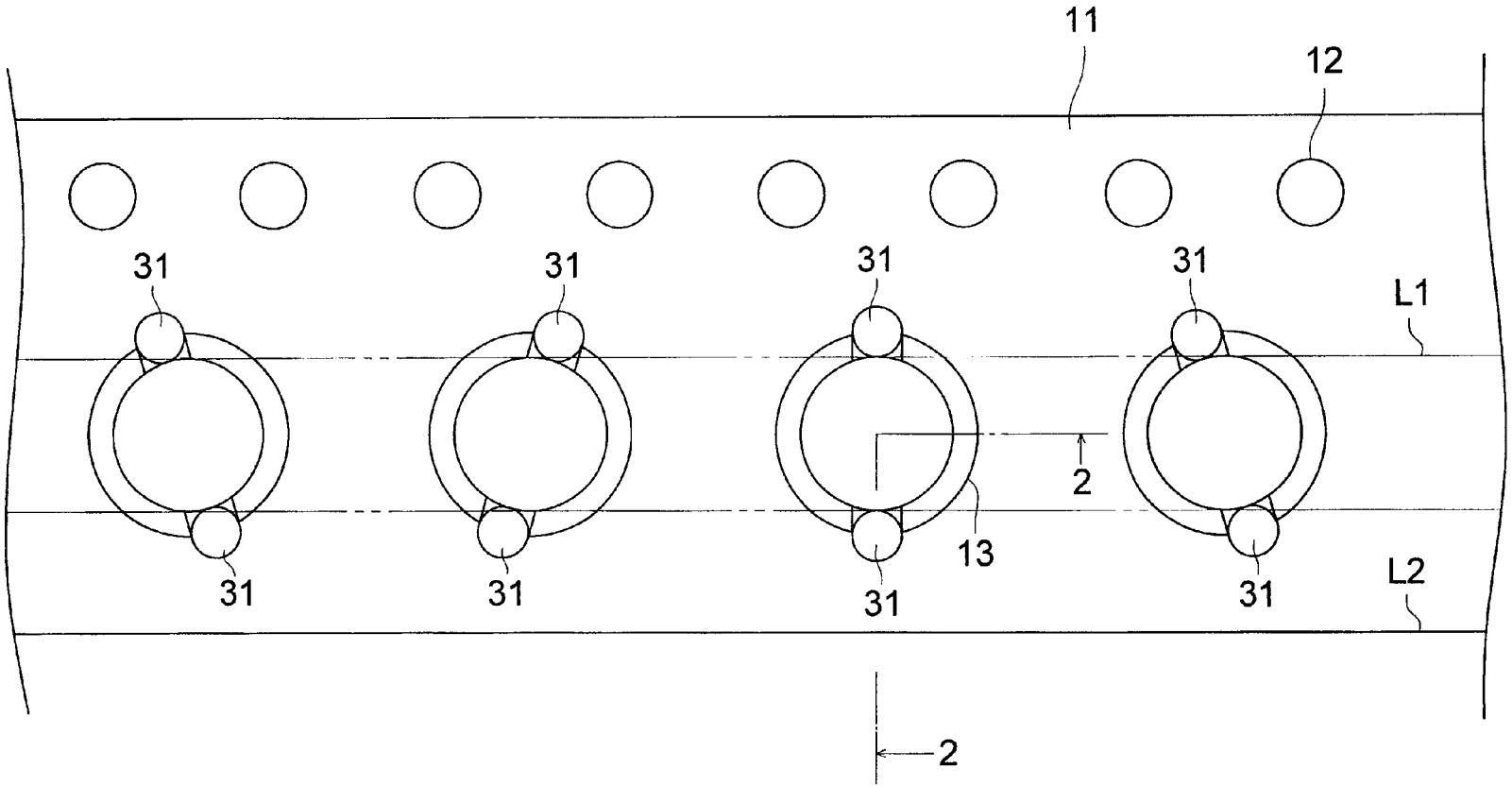
FIG. 1 is a plan for explaining the first example of the embodiment of this invention.

In the following, examples of the embodiment of this invention will be explained by referring to the drawings.

(1) First Example of the Embodiment

The first example of the embodiment will be explained by referring to FIG. 1 to FIG. 3. FIG. 1 is a plan, FIG. 2 is an enlarged cross-sectional view at the cutting line 2—2 in FIG. 1, and FIG. 3 is a cross-sectional view in the case where one lens housing portion and another lens housing portion overlap each other when the carrier tape is wound round.

Figure 2:
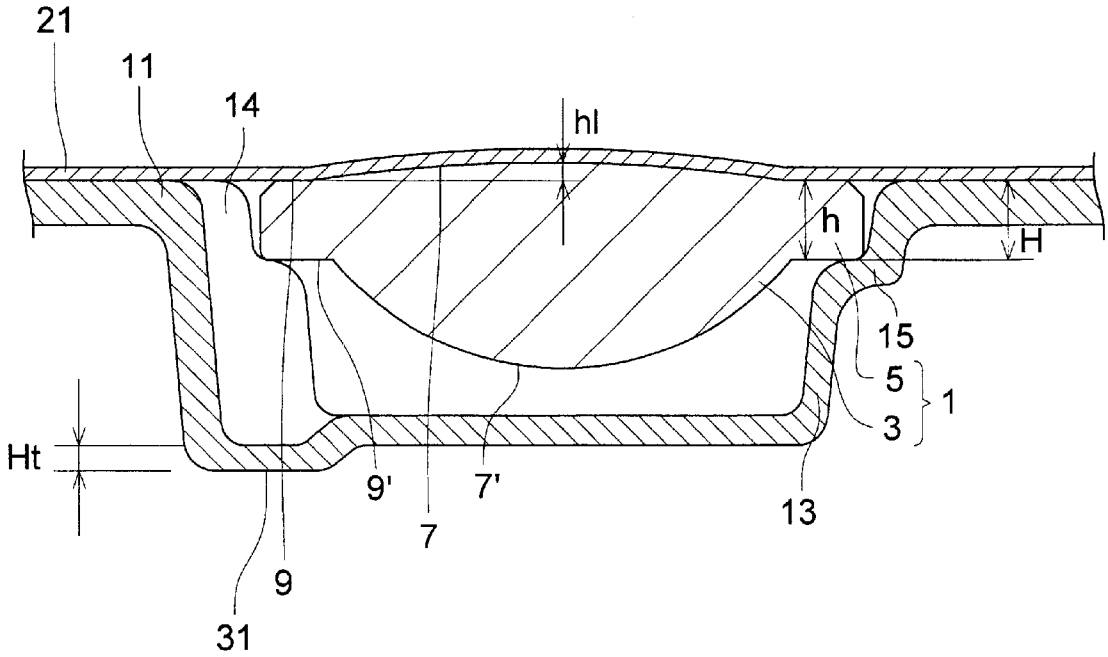
FIG. 2 is an enlarged cross-sectional view at the cutting line 2—2 in FIG. 1.
Figure 3:
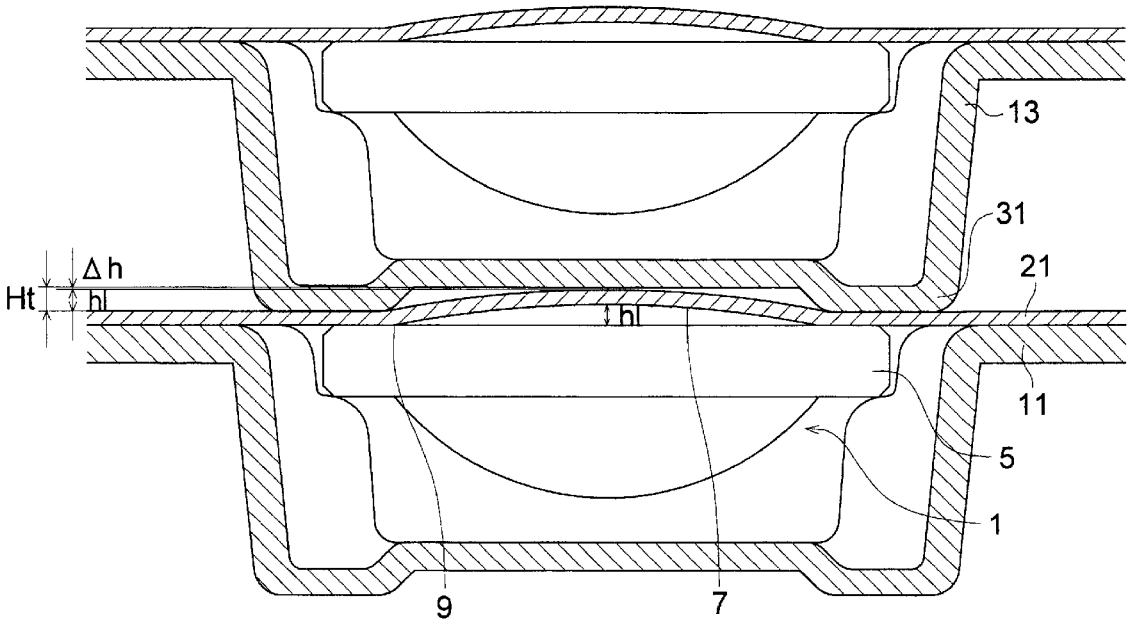
FIG. 3 is a cross-sectional view in the case where one lens housing portion and another lens housing portion overlap each other when the carrier tape is wound round.

Besides, as shown in FIG. 2, the lens 1 which is explained in the examples of the embodiment of this invention is composed of the lens main body 3 and the flange portion 5 formed along the edge of the lens main body 3, and it is taken as the subject such one that at least one lens surface, the lens surface 7 in the examples of the embodiment of this invention, projects out of the ring-shaped surface 9 of the flange portion 5.

In the long carrier tape 11, the plural cylindrical-shaped lens housing portions 13 are formed by a method such as a thermal forming method.

In this lens housing portion 13, the lens 1 is housed in such a manner that the lens surface 7 which projects out of the ring-shaped surface 9 of the flange portion 5 comes to the opening 14 side, and the supporting portion 15 for supporting the ring-shaped surface 9' of the flange portion 5 of the lens 1 on the reverse side to the opening 14 is formed.

Moreover, the lens housing portion 13 of the carrier tape is designed in such a manner that the depth (H) from the supporting portion 15 to the opening 14 of it is approximately equal to the thickness (h) of the flange portion of the lens 1.

Accordingly, the top portion of the lens surface 7 of the lens 1 projects out of the carrier tape 11.

Further, the long cover tape 21 is stuck on the carrier tape 11 in order to cover the lens 1 housed in the lens housing portion 13.

On the bottom surface of each of the lens housing portions 13, the two projections 31 are formed. The height (Ht) of these projections 31 from the lens housing portion 13 is not smaller than the projection amount (hl) of the other lens surface 7 of the lens 1 from the other ring-shaped surface 9 of the flange portion 5.

Further, for the positions to provide the projections 31, they are formed in the outer side areas of the tangents L1 and L2, which are tangent to the circular edge of the lens surface 7 of the lens 1 to be housed and parallel to the winding direction of the carrier tape.

Further, as shown in FIG. 1, between any two projections 31 that are adjacent to each other in the winding direction, the positions of the projections 31 with respect to the pertinent lens housing portion are different.

In addition, 12 denotes the holes for centering which are engaged with cores of a device for feeding a tape or winding it.

According to the above-mentioned structure, as shown in FIG. 3, when the carrier tape is wound round, even in the case where one lens housing container and another lens housing container overlap each other, because the height (Ht) of the projections 31 from the lens housing portion 13 is made equal to or larger than the projection amount (hl) of the lens surface 7 of the lens 1 from the other ring-shaped surface 9 of the flange portion 5, a clearance Δh is formed between the portion of the cover tape 21 facing the lens surface 7 of the lens 1 housed in the lens housing portion 13 and the portion of the carrier tape 11 which is wound outside it, and the lens surface 7 of the lens 1 is not flawed.

By providing the projections on the bottom surface of the lens housing portion 13, the clearance between the portion of the cover tape 21 facing the lens surface 7 of the lens 1 housed in the lens housing portion 13 and the portion of the carrier tape 11 which is wound outside it can be set at a small value.

Further, by providing the projections 31 in the outer side areas of the tangents L1 and L2, which are tangent to the circular edge of the lens surface 7 of the lens 1 to be housed and parallel to the winding direction of the carrier tape 11, it never occurs that the projections 31 come into contact with the portion of the cover tape 21 facing the lens surface 7 of the lens 1, and the lens surface 7 of the lens 1 is not flawed.

Furthermore, by making the positions of the projections 31 with respect to the pertinent lens housing portion 13 different between any two projections which are adjacent to each other in the winding direction, the probability of any one projection being fitted into another projection is reduced when the carrier tape is wound round, and the probability of the lens surface 7 of the lens 1 being flawed is also reduced.

(2) Second Example of the Embodiment

Figure 4:
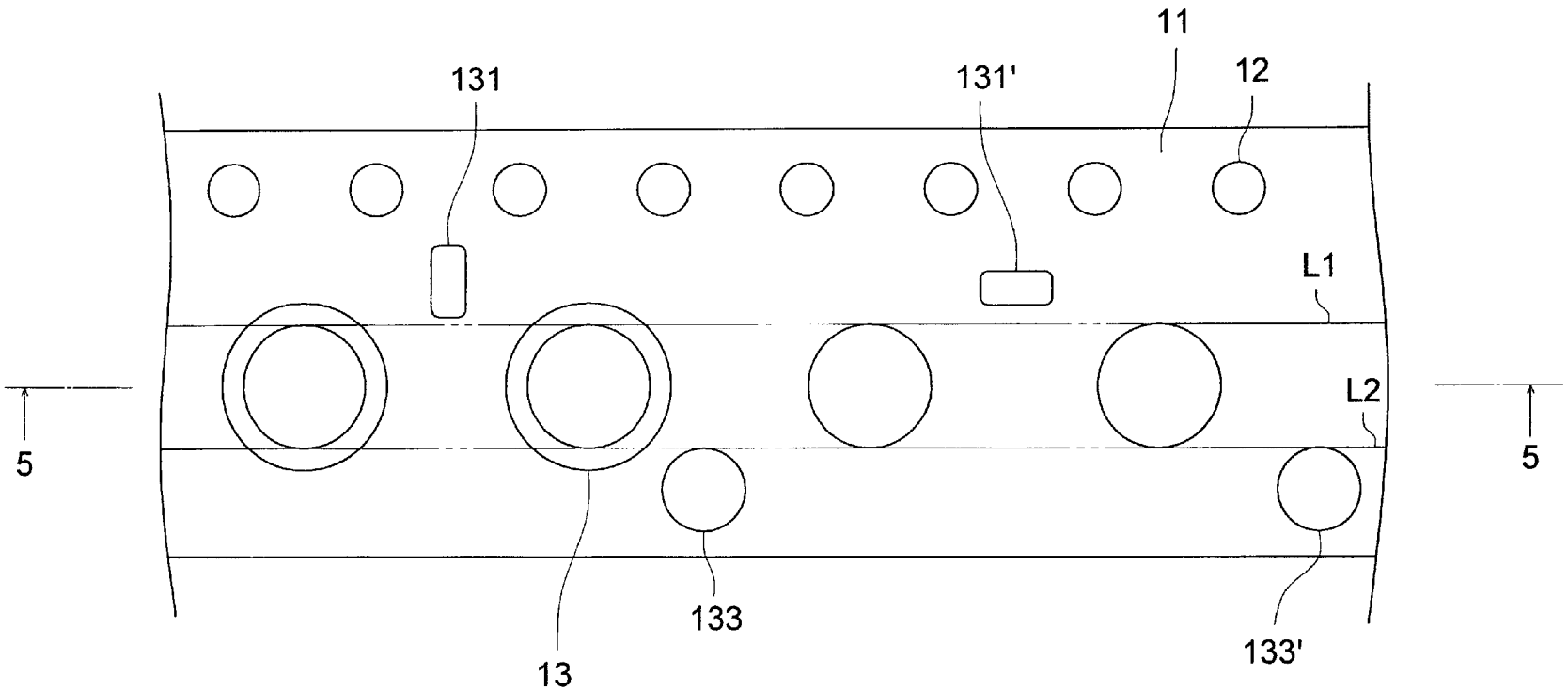
FIG. 4 is a plan for explaining the second example of the embodiment of this invention.
Figure 5:
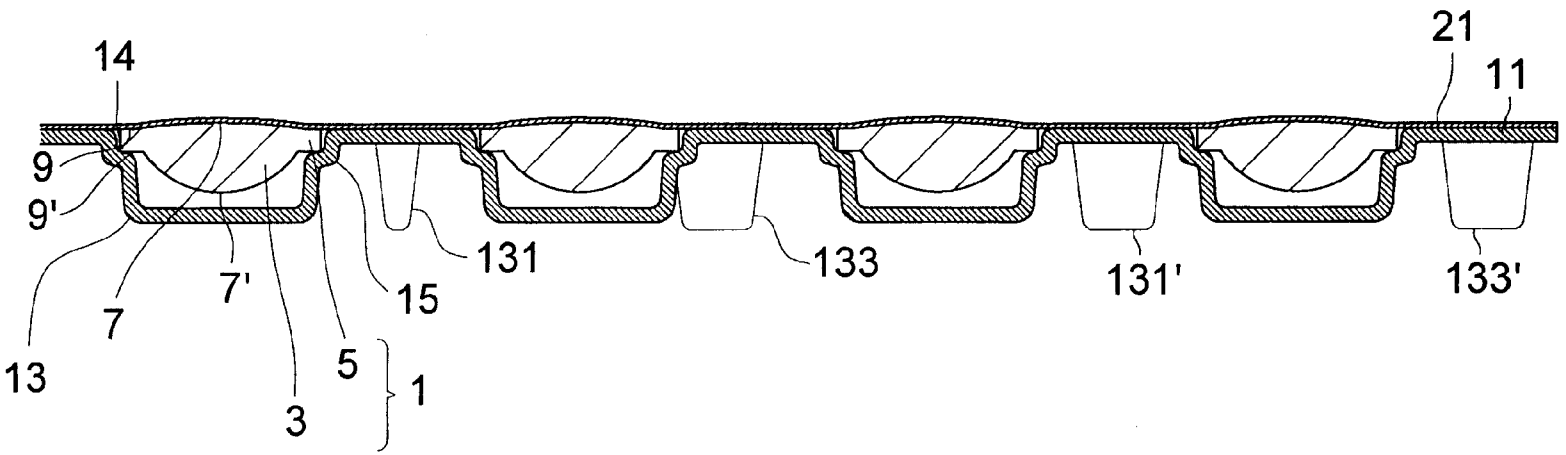
FIG. 5 is a cross-sectional view at the cutting line 5—5 in FIG. 4.
Figure 6:
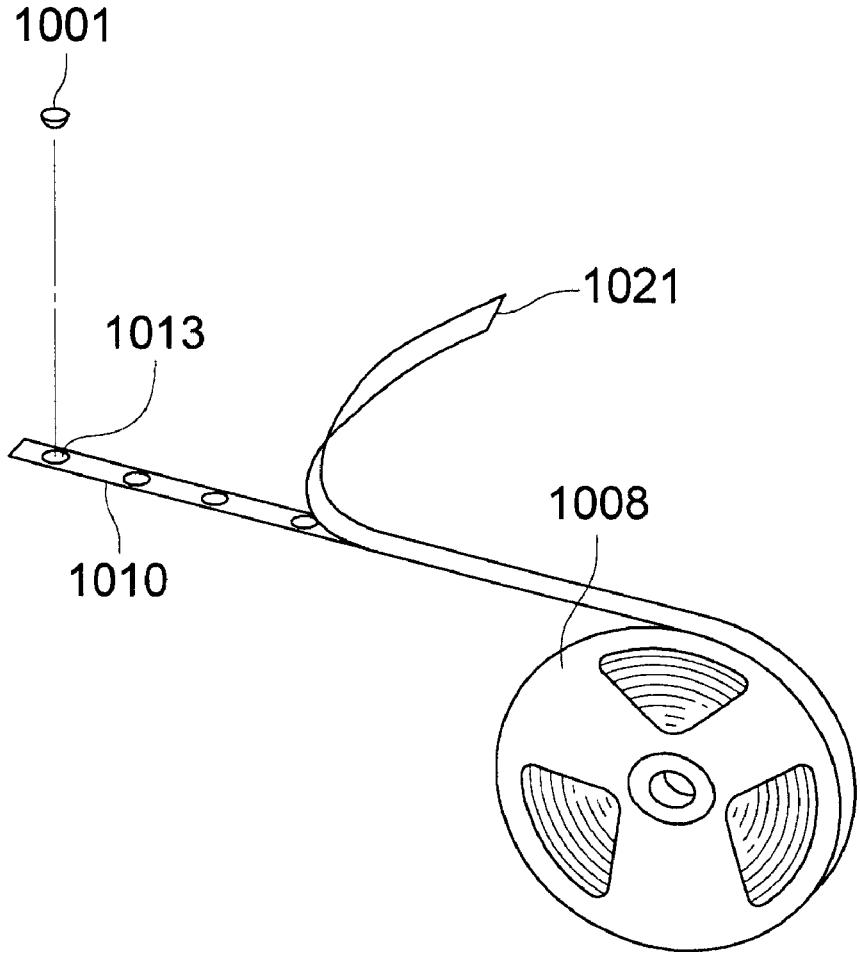
FIG. 6 PRIOR ART
FIG. 6 is a drawing for explaining the whole of a conventional lens housing container.
Figure 7:
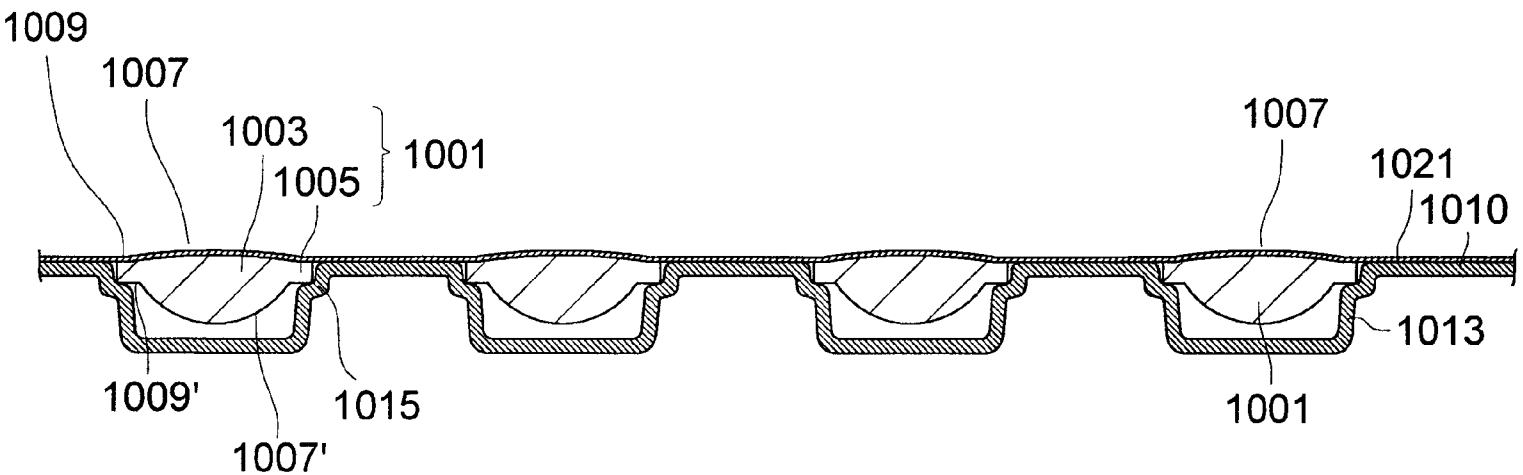
FIG. 7 is a cross-sectional view of a conventional lens housing container.
Figure 8:
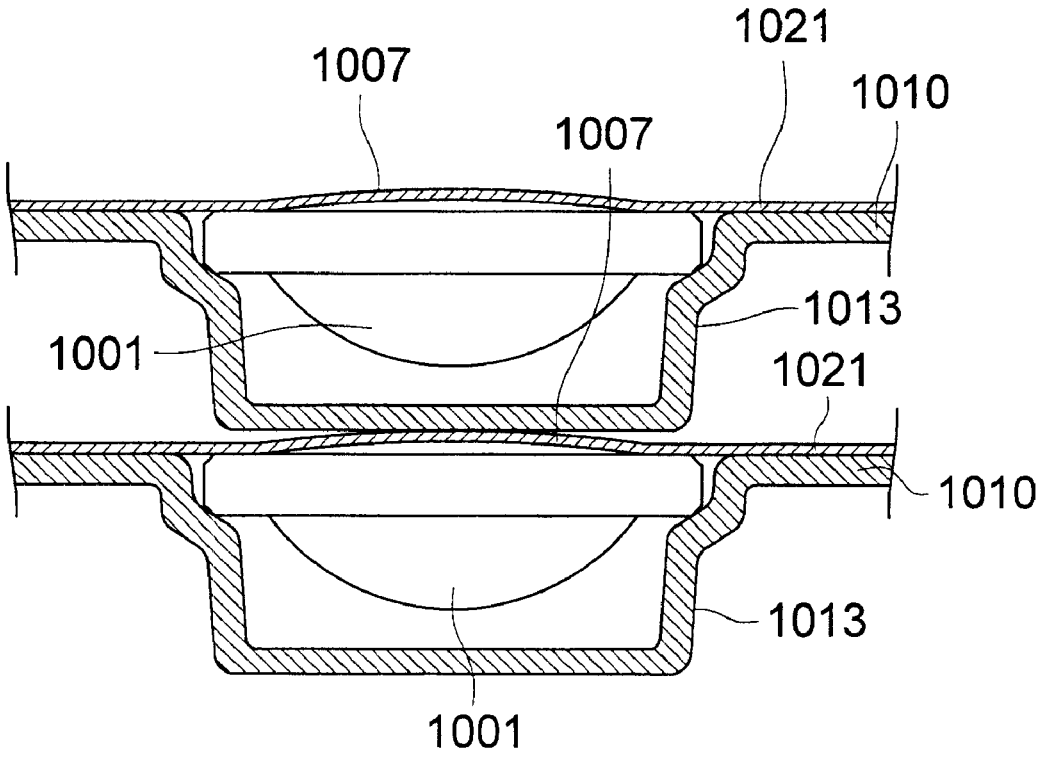
FIG. 8 PRIOR ART
FIG. 8 is a drawing for explaining a point of problem in a conventional lens housing container.

Explanations will be given by referring to FIG. 4 and FIG. 5. FIG. 4 is a plan and FIG. 5 is a cross-sectional view at the cutting line 5—5 in FIG. 4. In addition, the same signs are put to the same parts as the first example of the embodiment, and repeated explanations will be omitted.

The point of difference between the first example of the embodiment and the second example of the embodiment is the projection. In the first example of the embodiment, the projections are provided on the bottom surface of the lens housing portion 13; however, as shown in FIG. 4, the projections 131 (131') and 133 (133') are provided at the positions other than the bottom surface of the lens housing portion 13.

Among these, with respect to the projection 131 (131') formed in the outer side area of the tangent L1, which is tangent to circular edge of the lens surface 7 of the lens 1 and parallel to the winding direction of the carrier tape 11, the two projections 131 and 131', which are adjacent to each other in the winding direction, have different cross-sectional shapes in the direction perpendicular to the height direction respectively. That is, as shown in FIG. 4, the cross-sectional shape of the projection 131 is a rectangle that is long lengthwise, and the cross-sectional shape of the projection 131' is a rectangle that is long widthwise; these kinds of projections are alternately formed.

Further, regarding the projections 133 (133') formed in the outer side area of the tangent L2, the projections 133 and 133' have the same cross-sectional shape but are different in the position with respect to the lens housing portion 13. That is, as shown in FIG. 5, regarding the two neighboring projections 133 and 133', the projection 133 which is located near to the leftward lens housing portion 13 and the projection 133' which is located near to the rightward lens housing portion 13 are alternately formed.

Further, the height of the projections 131 (131') and 133 (133') is made equal to or larger than the sum of the projection amount of the lens housing portion 13 from the carrier tape 11 and the projection amount of the lens surface 7 of the lens 1 from the ring-shaped surface 9 of the flange portion 5; this height is the same as that in the first example of the embodiment.

According to the above-mentioned structure, when the carrier tape is wound round, even in the case where one lens housing portion and another lens housing portion overlap each other, because the height of the projections 131 (131') and 133 (133') is made equal to or larger than the sum of the projection amount of the lens housing portion 13 from the carrier tape 11 and the projection amount of the lens surface 7 of the lens 1 from the ring-shaped surface 9 of the flange portion 5, a clearance Δh is formed between the portion of the cover tape 21 facing the lens surface 7 of the lens 1 housed in the lens housing portion 13 and the portion of the carrier tape 11 which is wound outside it, and the lens surface 7 of the lens 1 is not flawed.

Further, by providing the projections 131 (131') and 133 (133') in the outer side areas of the tangents L1 and L2, which are tangent to the circular edge of the lens surface 7 of the lens 1 to be housed and parallel to the winding direction of the carrier tape 11, it never occurs that the projections 131 (131') and 133 (133') come into contact with the portion of the cover tape 21 facing the lens surface 7 of the lens 1, and the lens surface 7 is not flawed.

Further, regarding the projection 131 (131'), by making the two projections 131 and 131', which are adjacent to each other in the winding direction, have different cross-sectional shapes in the direction perpendicular to the height direction respectively, the probability of the projection 131 being fitted into the projection 131' is reduced, and the probability of the lens surface 7 of the lens 1 being flawed is also reduced.

Further, by making different the positions of the projections 133 and 133' with respect to the pertinent lens housing portion 13, the probability of the projection 133 being fitted into the projection 133' is reduced, and the probability of the lens surface 7 of the lens 1 being flawed is also reduced.

Besides, in the above-mentioned first and second examples of the embodiment, explanations have been given for an example in which the cover tape 21 with a broad width is used and the projections 31 and the projections 131 and 133 are made to come into contact with the cover tape 21; however, because the width of the cover tape 21 is enough if it covers the opening 14 of the lens housing portion 13, for example, it is also appropriate that the projections 131 and 133 in the second example of the embodiment are formed at further outer positions from the tangents L1 and L2, and the projections 131 and 133 are made to come into contact with the carrier tape 11.

Further, in the above-mentioned first and second examples of the embodiment, the lens 1 is a convex lens, but the lens 1 may be a concave lens. In this case, the edge portion of the lens surface projects out of the carrier tape 11 .

As described in the above, according to the invention of structure (9), in order to make a clearance, in the state that the carrier tape having the aforesaid cover tape stuck on it is wound round, between the portion of the cover tape facing the other lens surface of the lens housed in the aforesaid lens housing portion and the portion of the carrier tape which is wound outside it, by forming projections coming into contact with the carrier tape or the cover tape in said carrier tape, the lens surface is not flawed when the carrier tape having the cover tape stuck on it is wound round.

According to the invention of structure (10), by forming the aforesaid projections in the outer side area of the tangents, which are tangent to the circular edge of the other lens surface of the lens to be housed and parallel to the winding direction of the aforesaid carrier tape, it never occurs that the projections come into contact with the portion of the cover tape facing the other lens surface of the lens, and the lens surface is not flawed.

According to the invention of structure (11), by making the height of the aforesaid projections [equal to or] larger than the sum of the projection amount of the aforesaid lens housing portion from the aforesaid carrier tape, and the projection amount of the other lens surface of the aforesaid lens from the ring-shaped surface of the aforesaid flange portion, the portion of the cover tape facing the lens surface does not come into contact with the bottom surface of the lens housing portion of the carrier tape which is wound outside it; therefore, the lens surface is not flawed.

According to the invention of structure (12), by providing the aforesaid projections on the bottom surface of the aforesaid lens housing portion, the clearance between the portion of the cover tape being in contact with the other lens surface of the lens housed in the aforesaid lens housing portion and the portion of the carrier tape which is wound outside it can be set at a small value.

According to the invention of structure (13), by making the aforesaid projections be of at least any one of the kinds of projections one of which is such one that any two projections which are adjacent to each other in the winding direction have different cross-sectional shapes in the direction perpendicular to the height direction of said projections respectively and the other of which is such one that any two projections which are adjacent to each other in the winding direction are located at different positions with respect to the aforesaid lens housing portions, the probability of one projection fitting into another projection is reduced when the carrier tape is wound round.

Disclosed embodiment can be varied by a skilled person without departing from the spirit and scope of the invention.

What is claimed is:

1. A lens housing container for housing a plurality of lenses, comprising:

(a) a long carrier tape having a plurality of supporting portions each for supporting one ring-shaped surface of a flange portion of each of the plurality of lenses, and a plurality of lens housing portions; and (b) a long cover tape which is stuck on the carrier tape so as to cover each of the plurality of lenses housed in each of the plurality of lens housing portions, wherein each of the plurality of supporting portions supports the one ring-shaped surface of the flange portion of the lens, so as not to come into contact with the one lens surface of each lens, each of the plurality of lens housing portions houses each lens so that a part of the other lens surface of each lens is projected from or is flush with the upper surface of the carrier tape, the cover tape restrains each lens housed in the plurality of lens housing portions from moving in an optical axis direction thereof, the carrier tape has projections, and in order to make a clearance, in the state that the carrier tape having the cover tape stuck thereon is wound round, between a portion of the cover tape facing the other lens surface of each lens housed in the plurality of lens housing portions and a portion of the carrier tape which is wound outside thereof, the projections of the carrier tape which is wound outside come into contact with the portion of the carrier tape or the cover tape which is wound inside.

2. The lens housing container of claim 1, wherein the cover tape is in contact with the other surface of each lens housed in the plurality of lens housing portions.

3. The lens housing container of claim 1, wherein the projections are formed in an outer side area of a tangent which is tangent to a circular edge of the other lens surface of each lens to be housed and is parallel to a direction of winding of the carrier tape.

4. The lens housing container of claim 1, wherein each height of the projections is equal to or larger than a sum of a projection amount of each of the plurality of housing portions from the carrier tape and a projection amount of the other lens surface of each lens from the other ring-shaped surface of each of the flange portions.

5. The lens housing container of claim 1, wherein the projections are provided on a back surface of the plurality of lens housing portions.

6. The lens housing container of claim 1, wherein any two projections which are adjacent to each other in a winding direction among the projections have different cross-sectional shapes in a direction perpendicular to a height direction of the projections, respectively.

7. The lens housing container of claim 1, wherein any two projections which are adjacent to each other in a winding direction among the projections are located at different positions with respect to each of the lens housing portions.

8. The lens housing container of claim 1, wherein each of the plurality of lenses is a plastic lens.

9. A lens housing body comprising:

(a) a plurality of lenses; and (b) a lens housing container for housing the plurality of lenses, comprising:

(1) a long carrier tape having a plurality of supporting portions each for supporting one ring-shaped surface of a flange portion of each of the plurality of lenses, and a plurality of lens housing portions; and (2) a long cover tape which is stuck on the carrier tape so as to cover each of the plurality of lenses housed in each of the plurality of lens housing portions, wherein each of the plurality of supporting portions supports the one ring-shaped surface of the flange portion of the lens, so as not to come into contact with the one lens surface of each lens, each of the plurality of lens housing portions houses each lens so that a part of the other lens surface of each lens is projected from or is flush with the upper surface of the carrier tape, the cover tape restrains each lens housed in the plurality of lens housing portions from moving in an optical axis direction thereof, the carrier tape has projections, and in order to make a clearance, in the state that the carrier tape having the cover tape stuck thereon is wound round, between a portion of the cover tape facing the other lens surface of each lens housed in the plurality of lens housing portions and a portion of the carrier tape which is wound outside thereof, the projections of the carrier tape which is wound outside come into contact with the portion of the carrier tape or the cover tape which is wound inside.

10. The lens housing body of claim 9, wherein each of the plurality of lenses is a plastic lens.

* * * * *